US010775014B2

(12) United States Patent
Chen et al.

(10) Patent No.: US 10,775,014 B2
(45) Date of Patent: Sep. 15, 2020

(54) VEHICLE HEADLIGHT ASSEMBLY AND A CORRESPONDING LAMP

(71) Applicant: Lumileds LLC, San Jose, CA (US)

(72) Inventors: Shengjin-Sj Chen, Shanghai (CN); Xin Sheng, Aachen (DE); Yuanyuan Wang, Aachen (DE)

(73) Assignee: Lumileds LLC, San Jose, CA (US)

( * ) Notice: Subject to any disclaimer, the term of this patent is extended or adjusted under 35 U.S.C. 154(b) by 0 days.

(21) Appl. No.: 16/312,198

(22) PCT Filed: Jun. 14, 2017

(86) PCT No.: PCT/EP2017/064510
§ 371 (c)(1),
(2) Date: Dec. 20, 2018

(87) PCT Pub. No.: WO2017/220394
PCT Pub. Date: Dec. 28, 2017

(65) Prior Publication Data

US 2019/0242544 A1 Aug. 8, 2019

(30) Foreign Application Priority Data

Jun. 22, 2016 (WO) ..... PCT/CN2016/086681
Jul. 21, 2016 (EP) ..... 16180568

(51) Int. Cl.

| | |
|---|---|
| ***F21S 41/365*** | (2018.01) |
| ***F21S 41/147*** | (2018.01) |
| ***F21S 41/19*** | (2018.01) |
| ***F21S 41/692*** | (2018.01) |
| ***F21Y 115/10*** | (2016.01) |
| ***F21S 41/43*** | (2018.01) |

(52) U.S. Cl.
CPC ..... *F21S 41/365* (2018.01); *F21S 41/147* (2018.01); *F21S 41/192* (2018.01); *F21S 41/435* (2018.01); *F21S 41/692* (2018.01); *F21Y 2115/10* (2016.08)

(58) Field of Classification Search
None
See application file for complete search history.

(56) References Cited

U.S. PATENT DOCUMENTS

2010/0085769 A1* 4/2010 Tatsukawa ..... F21S 41/147 362/539
2015/0308649 A1* 10/2015 Chen ..... F21S 41/143 362/516
2016/0003437 A1* 1/2016 Sakashita ..... F21S 41/147 362/516

FOREIGN PATENT DOCUMENTS

DE 102011005429 A1 9/2012
DE 102011007123 A1 11/2012
(Continued)

*Primary Examiner* — Ashok Patel
(74) *Attorney, Agent, or Firm* — Volpe and Koenig, P.C.

(57) ABSTRACT

The present invention provides a lamp for a horizontal operating position within a vehicle headlight assembly. The lamp, as seen with respect to the vehicle, comprises a LED light source for emitting light mainly to one side, and a reflective member for shielding front and lower parts of the light emitted by the LED light source and reflecting them to desired directions. The present invention also provides a vehicle headlight assembly comprising such a lamp, and, further, a reflector for shaping the light emitted by the LED light source into a beam, and a shuttle, adjustable between positions to shape the beam into a high beam or a low beam.

7 Claims, 3 Drawing Sheets

(56) References Cited

FOREIGN PATENT DOCUMENTS

| | | | |
|---|---|---|---|
| DE | 102013200925 | A1 | 7/2014 |
| JP | 2009259667 | A | 11/2009 |
| KR | 20150108797 | A | 9/2015 |
| WO | 2009037053 | A1 | 3/2009 |
| WO | 2012147024 | A1 | 11/2012 |
| WO | 2015032896 | A1 | 3/2015 |
| WO | 2016008738 | A1 | 1/2016 |

* cited by examiner

VEHICLE HEADLIGHT ASSEMBLY AND A CORRESPONDING LAMP

TECHNICAL FIELD

The present invention relates to a headlight assembly for vehicles and a corresponding lamp, or particularly, the present invention relates to a vehicle headlight assembly and a corresponding lamp and reflector design.

BACKGROUND

A typical vehicle headlight assembly includes a reflector and a lamp placed with its light source at or near the focal point of the reflector. Currently, the majority of such lamps are of halogen type while some high end automobiles use High Intensity Discharge (HID) lamps and, in recent years, not only HID lamps, but also light-emitting diode (LED) retrofit bulbs have also been introduced to such assembly. The reflector commonly includes a poly-ellipsoid rear portion and flat wall sections between the rear portion and the front of the assembly. The front is usually covered with a transparent lens. Typically, the lens, the reflector, or a combination of both is designed to direct the light from the light source into a specified pattern.

Several prior art methods have been used to control the light emitted from the lamp in vehicle headlight assemblies. One common method is to mount a shuttle in front of the bulb, to make the bulb having a dual function—a high beam and a low beam function through setting down or raising the shuttle. However, such a method of controlling the light emitted by the lamp results in inefficiencies in the headlight assembly, particularly for the low beam function, because they prevent a large percentage of the light emitted by the lamp from being used by the headlight assembly for example through absorption by the raised shuttle.

SUMMARY OF THE INVENTION

Therefore, it is an object of the present invention to solve at least one of the above-mentioned problems.

According to one aspect of the invention, there is provided a lamp for a horizontal operating position within a vehicle headlight assembly. The lamp comprises, as seen with respect to the vehicle: a LED light source for emitting light mainly to one side, and a reflective member for shielding front and lower parts of the light emitted by the LED light source and reflecting them to desired directions.

According to another aspect of the invention, there is provided a vehicle headlight assembly. The headlight assembly comprises the above lamp, a reflector for shaping the light emitted by the LED light source into a beam, and a shuttle, adjustable between positions to shape the beam into a high beam or a low beam.

By scenarios or as a whole, the present invention will probably improve efficiencies of the vehicle headlight assembly or of the lamp integrated therein.

BRIEF DESCRIPTION OF THE DRAWINGS

The invention will be described in detail by reference to the following drawings, in which.

DETAILED DESCRIPTION OF THE DRAWINGS

Embodiments of the present invention will be described more fully hereinafter with reference to the accompanying drawings. This invention may, however, be embodied in many different forms and should not be construed as limited to the embodiments set forth hereafter.

Figure 1:
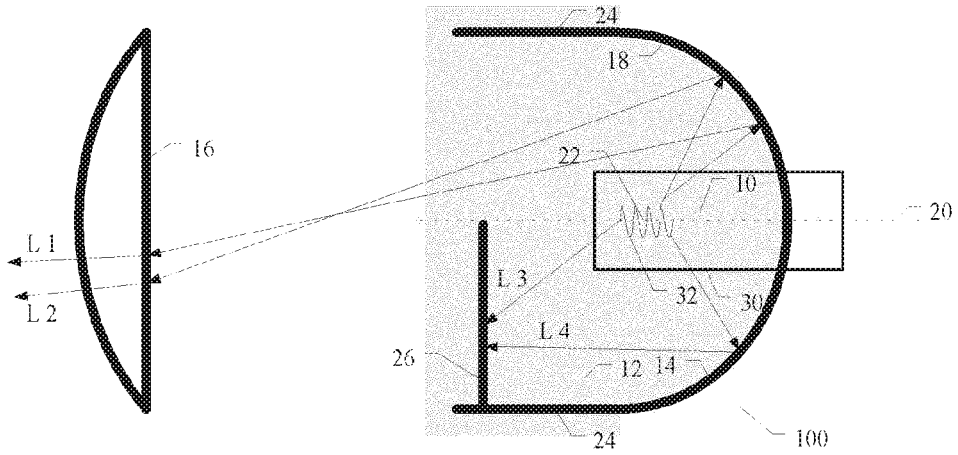
Fig. 1 (PRIOR ART)
FIG. 1 is a cross-sectional side view of a vehicle headlight assembly in accordance with the prior art.

FIG. 1 is a cross-sectional side view of a vehicle headlight assembly 100 in accordance with the prior art.

As is shown in FIG. 1, a lamp 10 is mounted within a cavity 12 of a reflector 14. The cavity 12 is closed by a transparent lens 16, which may have light-directing elements. The reflector 14 has a shaped, light-directing interior surface 18 that is usually poly-ellipsoid in shape, but may be parabolic or may have other shapes. The reflector 14 is configured for shaping light emitted by a light source of the lamp 10 into a high beam and a low beam, in combination with the lens 16 or not in combination with the lens 16. The poly-ellipsoid reflecting surface 18 has a central axis 20 and a focal point 22. The reflector 14 also may include walls 24, including a top wall, a bottom wall, and side walls which extend between light-directing surface 18 and lens 16. The walls 24 may have any suitable shape and may have a reflective coating, but are typically not designed for reflecting light in a desired direction.

The headlight assembly further comprises a shuttle 26 mounted in the lower part in front of the lamp 10, to make the lamp 10 having a dual function, high beam and low beam, through setting down or raising the shuttle 26. The shuttle is at least adjustable between a position in which the light from the light source is blocked across a maximum cross section and an essentially transmissive position in which this light is substantially allowed to pass through, i.e., to pass through for the high beam and to be blocked for the low beam. The reflector further includes a heel portion for mounting of the lamp 10. Typically, the heel portion is located on the axis 20 of reflecting surface 18. The lamp 10 can be mounted in reflector 14 by any suitable mounting structure as known in the art, for example the lamp 10 can be supported by a lamp base and a mounting strap. The lamp base is provided with electrical conductors for connecting the contact pins of the lamp 10 to a source of electrical energy in conventional fashion. The lamp 10 can be any suitable lamp, but is typically a halogen type lamp, such as the one shown in FIG. 1, a LED retrofit lamp, a LED lamp, a laser lamp, or any new substitute. It is noted that a LED retrofit lamp refers to a lamp that is compatible with a mounting structure for a halogen type lamp and the lamp illuminates with light-emitting diodes. A LED lamp generally has a module of light-emitting diodes and is incompatible with a mounting structure for a halogen type lamp. A LED light source may be comprised in a LED lamp or a LED retrofit lamp. As the headlight assembly for vehicles evolves and LED technology develops, the LED lamp may be widely applied in the headlight assembly for vehicles.

The lamp 10 includes a hermetically sealed, light-transmissive lamp envelope 30 and a filament 32 sealed within the envelope 30. The filament 32 functions as the light source. It is noted that a light source herein is referred to as a source for emitting light, i.e., does not include the envelope, and thus differs from a lamp e.g. in that a lamp may have an envelope.

The envelope 30 is preferably fabricated of a hard or quartz glass material such as borosilicate or aluminosilicate glass. It will be understood that the envelope and light source structure of the lamp 10 may have configurations other than that shown in FIG. 1. The lamp 10 is preferably mounted in reflector 14 such that the longitudinal axis of filament 32 coincides with the central axis 20 of poly-ellipsoid reflecting surface 18 and such that the center of filament 32 is located at or near the focal point 22 of poly-ellipsoid reflecting surface 18 and at or near the central axis of envelope 30. This ensures that light emitted by filament 32 and incident on poly-ellipsoid reflecting surface 18 is reflected through lens 16 as a light beam approximately originating from a single point.

As is shown in FIG. 1, upward light such as light L1 and L2 is emitted out of the headlight assembly, while downward light such as light L3 and L4 is blocked by the shuttle 26 and thus light efficiencies are greatly reduced.

Figure 2:
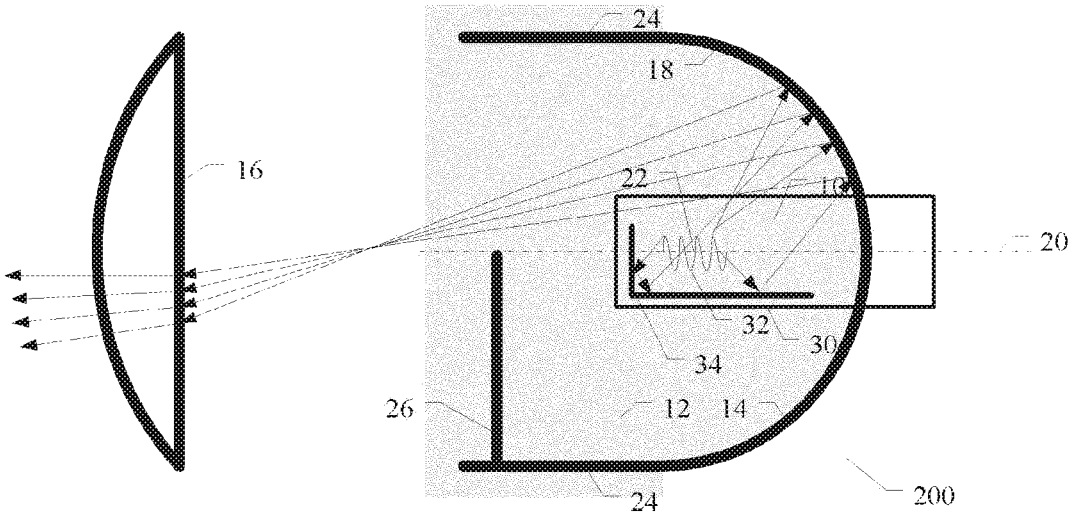
FIG. 2 is a cross-sectional side view of a vehicle headlight assembly not claimed by the present invention.

A vehicle headlight assembly 200 not claimed by the present invention is shown in FIG. 2. As is shown in FIG. 2, a lamp 10 is mounted within a cavity 12 of a reflector 14. The cavity 12 is closed by a transparent lens 16, which may have light-directing elements. The reflector 14 has a shaped, light-directing interior surface 18 that is usually poly-ellipsoid in shape, but may be parabolic or may have other shapes. The reflector 14 is configured for shaping light emitted by the light source into a high beam and a low beam, in combination with the lens 16 or not in combination with the lens 16. The poly-ellipsoid reflecting surface 18 has a central axis 20 and a focal point 22. The reflector 14 also may include walls 24, including a top wall, a bottom wall, and side walls which extend between light-directing surface 18 and lens 16. The walls 24 may have any suitable shape and may have a reflective coating, but are typically not designed for reflecting light in a desired direction.

The vehicle headlight assembly further comprises a shuttle 26 mounted in the lower part in front of the lamp 10, to make the lamp 10 having a dual function, high beam and low beam functions, through setting down or raising the shuttle 26. The shuttle is at least adjustable between a position in which the light from the light source is blocked across a maximum cross section and an essentially transmissive position in which this light is substantially allowed to pass through. In practice, the shuttle can be set down, but cannot completely disappear, therefore, still part of the light emitted by the light source is prevented from exiting from the headlight assembly and light inefficiency results.

The lamp 10 includes a hermetically sealed, light-transmissive lamp envelope 30 and a filament 32 sealed within the envelope 30. The filament 32 functions as the light source. The envelope 30 is preferably fabricated of a hard or quartz glass material such as borosilicate or aluminosilicate glass.

Not claimed by the present invention, a reflective member 34 in front of and below the light source is provided.

Generally, the light source is located at or near the focal point 22 of the surface 18, and preferably, the reflective member 34 is closely located to the light source, for example filament 32, i.e., near the focal point 22 of the surface 18, so that stray reflections and glare may be reduced.

The envelope 30 is formed as a cylinder in FIGS. 1 and 2, but actually it can be of any shape as appropriate. To ensure that as much as possible (i.e. substantially all) of the light emitted by filament 32 that will otherwise finally be blocked by the shuttle 26 is reflected by the reflective member 34 to the shaped, light-directing surface 18 of the reflector 14, the reflective member 34 is mounted in front of and under the light source as is shown in FIG. 2, to reflect the light going forward and downward to the upper part of the reflector 14. As is seen from the side view of FIG. 2, the reflective member 34 has an "L" shaped cross section for its reflecting part. As a result, the light is reflected by shaped, light-directing surface 18 in a desired direction, thereby increasing the useful output of the headlight assembly.

In a not claimed example, the reflective member 34 reflects light in a specular manner. Suitable specularly reflective materials include, but are not limited to, aluminum, silver, copper, chromium, nickel, gold, rhodium, palladium, platinum, and any combinations thereof.

As preferably the reflective member 34 is closely located to the light source, preferably the reflective member 34 is mounted inside the lamp envelope 30. Therefore, the selected reflective material must be able to withstand operating conditions for the life of the lamp without melting, evaporating, subliming or oxidizing. Some materials which can survive these conditions without degradation in performance include gold, platinum, palladium and rhodium.

Another approach is to mount the reflective member 34 outside the lamp envelope but still as close to the light source as possible.

In case the lamp will be operated in air, one may also coat the outer surface of the reflective member 34 or make the reflective member 34 out of a more easily oxidized reflective material, such as aluminum or silver, and to overcoat the reflective areas with a protective film, such as silicon dioxide, to prevent these materials from degrading when the lamp is operated in air.

Alternatively, a more easily oxidized reflective material, such as silver or aluminum, may be used by mounting the lamp in a reflector assembly which is hermetically sealed and which is filled with an inert atmosphere, such as nitrogen.

The size of the reflective member 34 can be determined empirically or by the use of computer modeling or a CAD system. In a headlight assembly, it is desirable that all of the light which leaves the headlight is reflected from the poly-ellipsoid reflecting surface 18 of the reflector 14, because the light is more controllable when it is reflected from the poly-ellipsoid surface. It is also desirable that the light be emitted from or near the focal point of the poly ellipsoid reflecting surface 18, since this light is directed in a controlled and predictable manner. Preferably, design of the reflective member 34 should consider these aspects.

In a not claimed example, the reflective member 34 has an "L" shaped cross section for its reflecting part. In another not claimed example, the reflective member 34 has an arc shaped cross section for its reflecting part.

The size of the reflective member is preferably small to fit a light source of small size, for example, the width of the reflective member is 3 mm for a LED retrofit light source.

It is noted that the reflective member 34 is advantageous for both high beam and low beam scenarios, due to light blocking otherwise occurring both in high beam and low beam scenarios.

It is noted that the reflective member 34 is particularly advantageous for a LED light source. Compared with a halogen filament, a LED light source is less compact, which leads to a light beam not well focused behind the lens 16 and not contributing to a maximum intensity of the beam pattern. The reflective member 34, which preferably is near the LED source, may help direct more light through the focus 22 behind the lens 16 and help get a higher maximum intensity.

Figure 3:
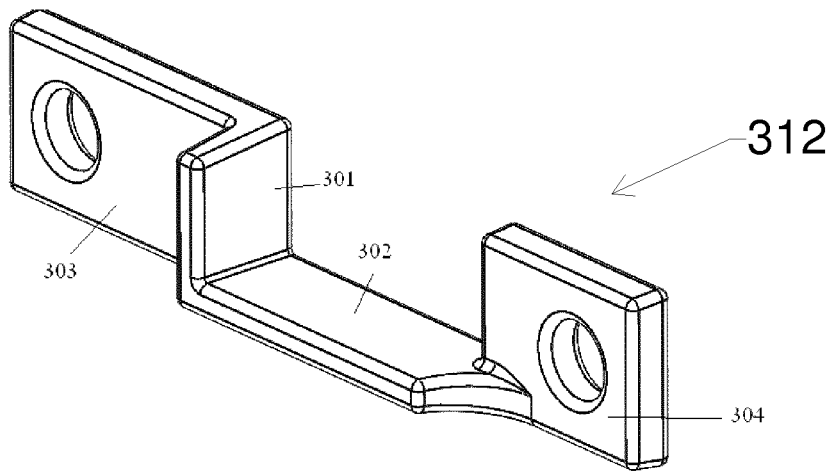
FIG. 3 is a schematic view of a reflective member of a vehicle headlight assembly in accordance with an embodiment of the present invention.

FIG. 3 is a schematic view of a reflective member 312 usable for an embodiment of the present invention in a vehicle headlight assembly 200 very similar to that shown in FIG. 2, in which the inventive reflective member 312 replaces the not claimed reflective member 34 in FIG. 2. The reflective member 312 in FIG. 3 has an "L" shaped cross section for the reflecting part, with one face 301 to reflect forward side light of the LED light source of an inventive lamp, and one face 302 to reflect down side light of the light source, as seen in the horizontal operating position of the lamp with respect to the vehicle. The reflective member 312 also has two parts 303 and 304 for it to be mounted in an inventive vehicle headlight assembly on the left and right sides of the "L" shape respectively, as seen in FIG. 3. Preferably, these two parts 303 and 304 will not further block desired light, or block it as little as possible to ensure high light efficiency.

Figure 4:
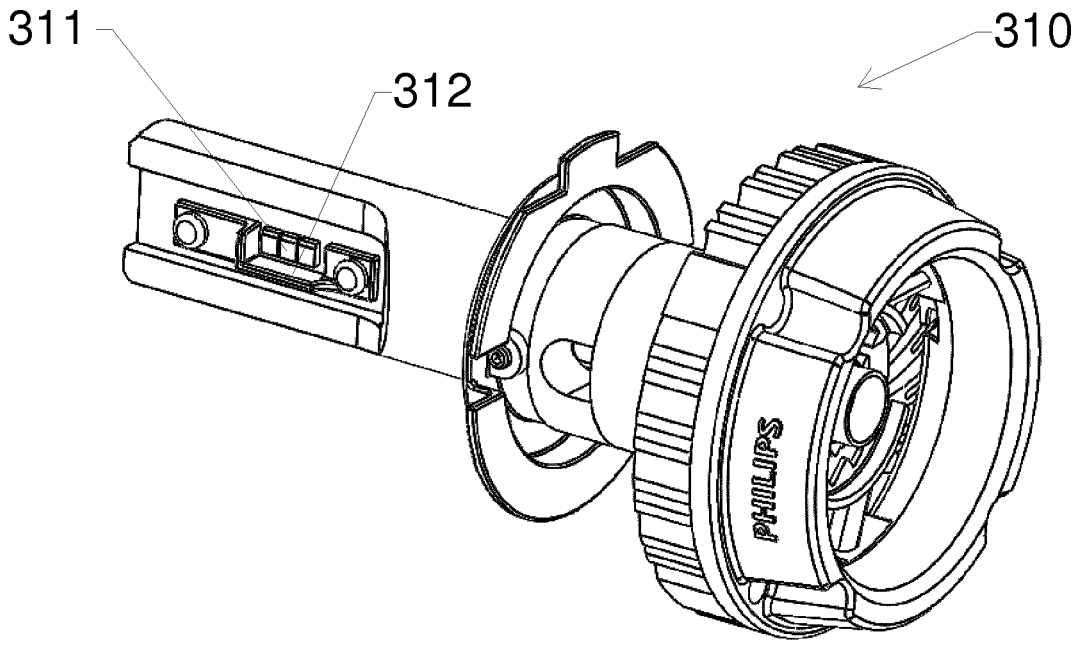
FIG. 4 is a schematic view of a LED retrofit product with a reflective member mounted therein in accordance with an embodiment of the present invention.

A schematic illustration of an inventive lamp is shown in FIG. 4 in form of a H7 LED retrofit product.

The "L" shaped reflective member 312 is mounted close to the light emitting chips forming the LED light source 311, only a very small distance away as required out of manufacturing reasons, such as mechanical mounting spaces. The reflective member 312 is not limited to "L" shape, but rather can apply a series of shapes as long as it can reflect forward and downward light to desired directions, thus may have, for example, an arc shape.

It's vital for the invention that the LED light source 311 mainly emits its light to one side. I.e., as seen in the horizontal mounting position of the inventive lamp in an inventive vehicle headlight assembly, the LED light source 311 mainly emits to one side, i.e., the left or the right side of the vehicle, and not upwards or downwards. In the illustration of FIG. 4, such side direction is diagonal between the left and out of the drawing plane. In other words, on installing lamp 310, in the orientation as shown in FIG. 4, in a vehicle headlight assembly, LED light source 311 mainly emits to the left side of the vehicle.

In a preferred embodiment of the invention, lamp 310 of FIG. 4 has an other LED light source on the side of lamp 310 which cannot be seen in FIG. 4, i.e., an other LED light source having a mirrored configuration to the LED light source 311 visible in FIG. 4. This other LED light source then mainly emits light to the other side of the inventive lamp 310, which, in the just discussed configuration of FIG. 4, means that this other LED light source mainly emits light to the diagonal between the right and behind the drawing plane of FIG. 4, i.e., to the right of the vehicle.

The mainly side emission of LED light source 311 allows direct utilization, i.e., without any intermediate redirection, of the main part of the emitted light by the side surfaces of reflector 14 in an inventive vehicle headlight assembly. Thus, by avoiding any intermediate redirections, e.g., by reflection at intermediate mirrors, any intermediate losses always connected with such redirections are avoided and the efficiency of lamp 310 is considerably increased. This allows for a compact LED light source with high luminance.

The latter is even further improved by using an other LED light source on the other side as explicated above. As all the LEDs of the two LED light sources can be placed very close to each other a very compact high luminance light source is obtained.

As said, the inventive concept of using mainly side emission avoids the necessity of redirecting the main part of the emitted light thus avoiding any loss mechanism for this part of the light. Furthermore, by using reflective member 312 in front of and below LED light source 311 further avoids loss of the otherwise unused part of the forward and downwards emitted light.

On using an other LED light source in mirrored configuration to LED light source 311, in order to use its forward and downwards emitted light an other reflective member in mirrored configuration to reflective member 312 is used on the other side of lamp 310.

Figure 5:
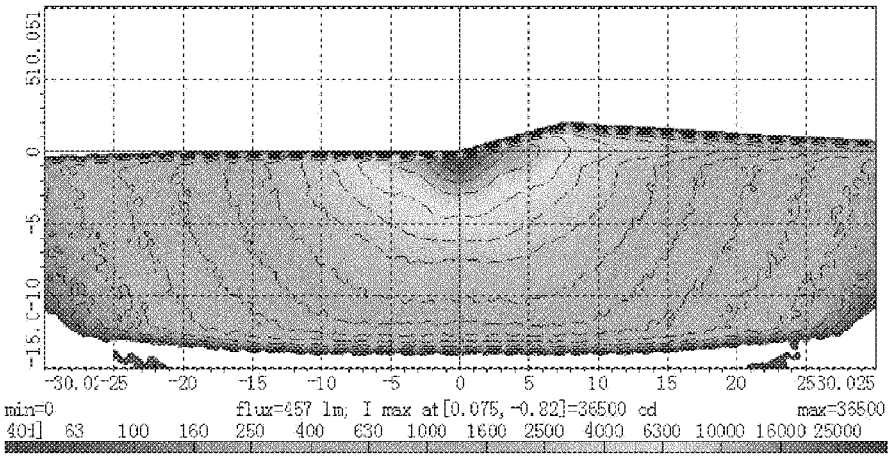
Fig. 5 (PRIOR ART)
FIG. 5 shows a simulation result of a vehicle headlight assembly with a traditional halogen bulb.
Figure 6:
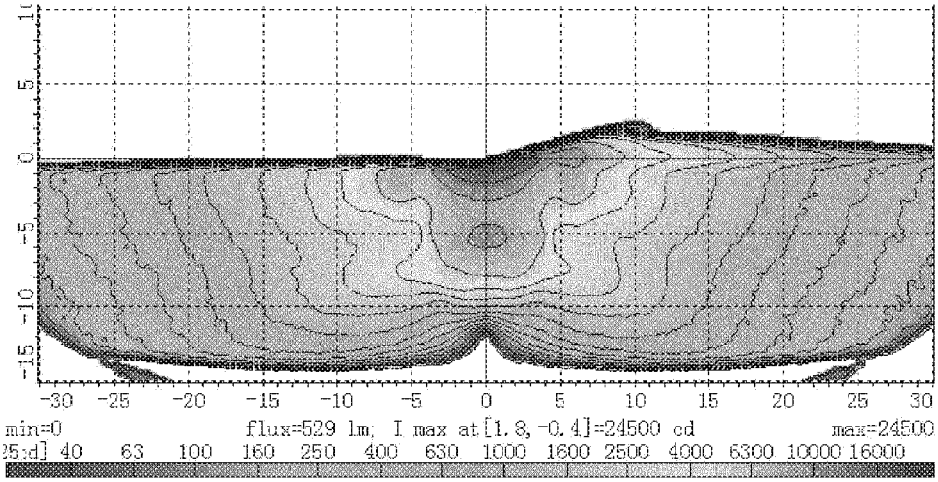
FIG. 6 shows a simulation result of a vehicle headlight assembly in accordance with the invention.

FIG. 5 shows a simulation result of a prior art vehicle headlight assembly with a halogen bulb and FIG. 6 shows a simulation result of an inventive vehicle headlight assembly integrated with a reflective member in accordance with the invention, respectively. The scenario for FIG. 5 has a vehicle headlight assembly with a traditional halogen bulb, which was found to produce 1560 lumen at 13.2 volts and to consume 60 watts. The scenario for FIG. 6 has a vehicle headlight assembly with an inventive retrofit LED product, which was found to produce 1350 lumen at 13.2 volts and to consume 16.6 watts. FIG. 5 and FIG. 6 are all results for low beam patterns on a standardized vertical screen in front of the vehicle.

Based on the simulation results, it can be seen that the flux out of the inventive headlight assembly in the scenario of FIG. 6 is 529 lumen vs. 457 lumen for the prior art headlight assembly in the scenario of FIG. 5, which shows an improved light efficiency by more than 15% (529/457*100%=115.7%, despite using a lamp with lower light output, i.e., 1350 instead of 1560 lumen).

Such improvements can be obtained for headlight assemblies with H7, HIR2, H18 and similar retrofit products.

While the exemplary embodiments of the present invention have been illustrated and described, it will be understood by those skilled in the art that various changes and modifications may be made, and equivalents may be substituted for elements thereof without departing from the true scope of the present invention. In addition, many modifications may be made to adapt to a particular situation and to the teaching of the present invention without departing from its central scope. Therefore it is intended that the present invention is not limited to the particular embodiments disclosed as the best modes contemplated for carrying out the present invention, but that the present invention includes all embodiments falling within the scope of the appended claims.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises", "comprising", "includes" and/or "including" used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

LIST OF REFERENCE NUMERALS

10 prior art lamp
12 reflector cavity
14 reflector
16 transparent lens
18 light-directing interior surface 18 of reflector 14
20 central axis of surface 18
22 focal point of surface 18
24 walls of reflector 1426 shuttle
30 envelope of lamp 10
32 filament of lamp 10
34 reflective member in front of and below the light source
100 prior art vehicle headlight assembly
200 not claimed vehicle headlight assembly
301 face of reflective member 34 for reflecting forward side light
302 face of reflective member 34 for reflecting downward side light
303, 304 parts for mounting reflective member 34
L1, L2 upward directed light
L3, L4 downward directed light

The invention claimed is:

1. A lamp for a predefined horizontal operating position within a vehicle headlight assembly of a vehicle, the lamp comprising:

a reference feature to allow insertion of the lamp into the vehicle headlight assembly in the predefined horizontal operating position;

a LED light source for emitting light to a first or a second side of the vehicle based on an orientation of the lamp based on the reference feature; and a reflective member for shielding front and lower parts of the light emitted by the LED light source and reflecting the front and lower parts of the light emitted by the LED light source to desired directions based on the orientation of the lamp based on the reference feature.

2. The lamp according to claim 1, wherein the reflective member is closely located to the LED light source.

3. The lamp according to claim 1, wherein the reflective member has an "L" shaped or an arc shaped cross section for its reflecting part.

4. The lamp according to claim 1, wherein the lamp is a LED retrofit lamp and the width of the reflective member is 3 mm.

5. The lamp according to claim 1, wherein the lamp has an envelope and the reflective member is located inside the envelope.

6. The lamp according to claim 1, wherein the lamp further comprises:

an other LED light source for emitting light mainly to the other side, and an other reflective member for shielding front and lower parts of the light emitted by the other LED light source and reflecting them to other desired directions.

7. A vehicle headlight assembly, comprising:

the lamp according to claim 1, a reflector for shaping the light emitted by the LED light source into a beam, and a shuttle, adjustable between positions to shape the beam into a high beam or a low beam.

* * * * *